US009499311B1

(12) United States Patent
Gilliam

(10) Patent No.: US 9,499,311 B1
(45) Date of Patent: Nov. 22, 2016

(54) TAMPER EVIDENT CROWN CAP SYSTEM AND METHOD

(75) Inventor: James R. Gilliam, Clearwater, FL (US)

(73) Assignee: SUPER CLOSURE INTERNATIONAL, LLC, Clearwater, FL (US)

( * ) Notice: Subject to any disclaimer, the term of this patent is extended or adjusted under 35 U.S.C. 154(b) by 230 days.

(21) Appl. No.: 13/590,732

(22) Filed: Aug. 21, 2012

Related U.S. Application Data

(63) Continuation-in-part of application No. 13/405,910, filed on Feb. 27, 2012, now Pat. No. 9,415,905, and a continuation-in-part of application No. 12/583,104, filed on Aug. 14, 2009, now abandoned, which is a continuation-in-part of application No. 12/387,618, filed on May 5, 2009, now abandoned.

(51) Int. Cl.
*B65D 41/12* (2006.01)
*B65D 41/28* (2006.01)

(52) U.S. Cl.
CPC ..... *B65D 41/28* (2013.01); *B65D 41/12* (2013.01); *B65D 41/125* (2013.01)

(58) Field of Classification Search
CPC .... B65D 41/10; B65D 41/105; B65D 41/12; B65D 41/125
USPC ..... 215/328, 329, 336, 337, 341, 348
See application file for complete search history.

(56) References Cited

U.S. PATENT DOCUMENTS 3,514,004 A * 5/1970 Hammersmith ..... 215/328
4,444,325 A * 4/1984 Lecinski, Jr. ..... 215/45
4,562,930 A * 1/1986 Lecinski et al. ..... 215/44
7,285,583 B2 * 10/2007 Stumphauzer et al. ..... 523/201

* cited by examiner

*Primary Examiner* — James N Smalley

(57) ABSTRACT

A crown cap is adapted to be removably coupled to a bottle. The crown cap has a circular central region and a downwardly extending side wall in a generally cylindrical configuration. The side wall having a circular periphery with a plurality of recesses to facilitate shaping of the side wall, side wall terminating in an inwardly scrolled lower edge. The central region of the crown cap radially terminates in an upwardly extending exterior projection. The crown cap has a downwardly extending interior projection radially interior of the exterior projection. An adhesive is provided in the exterior projection.

4 Claims, 4 Drawing Sheets

FIG. 1
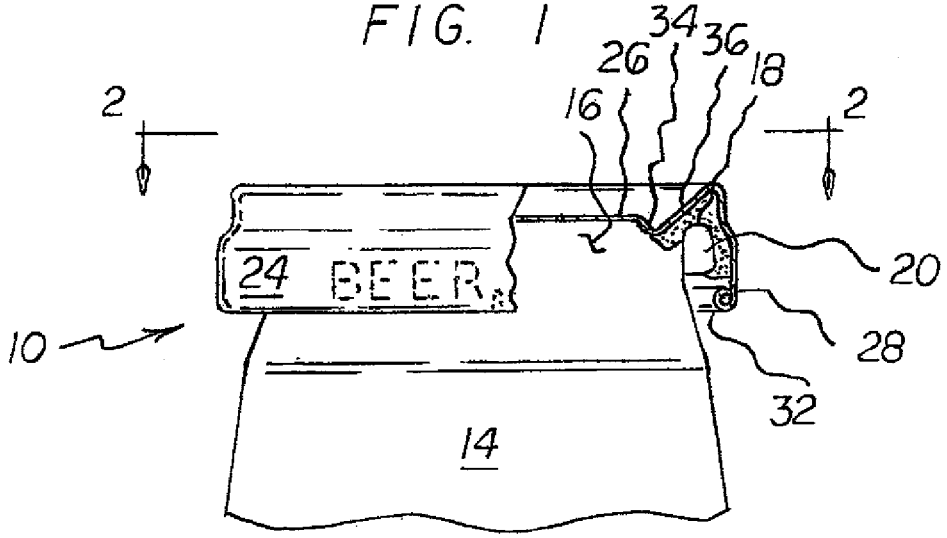
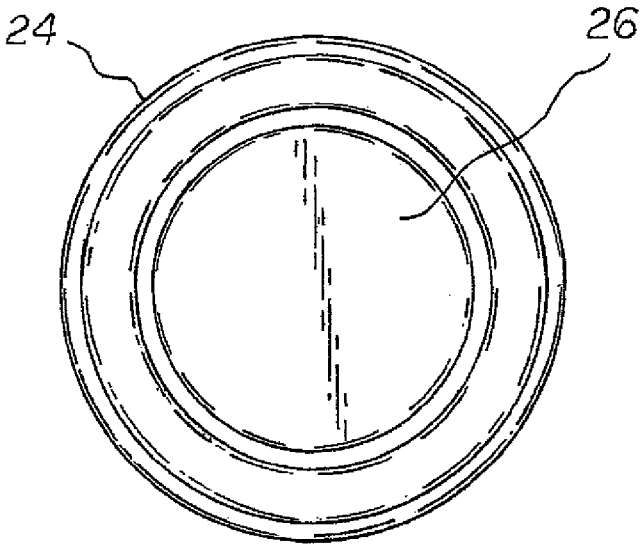
FIG. 2

FIG. 3
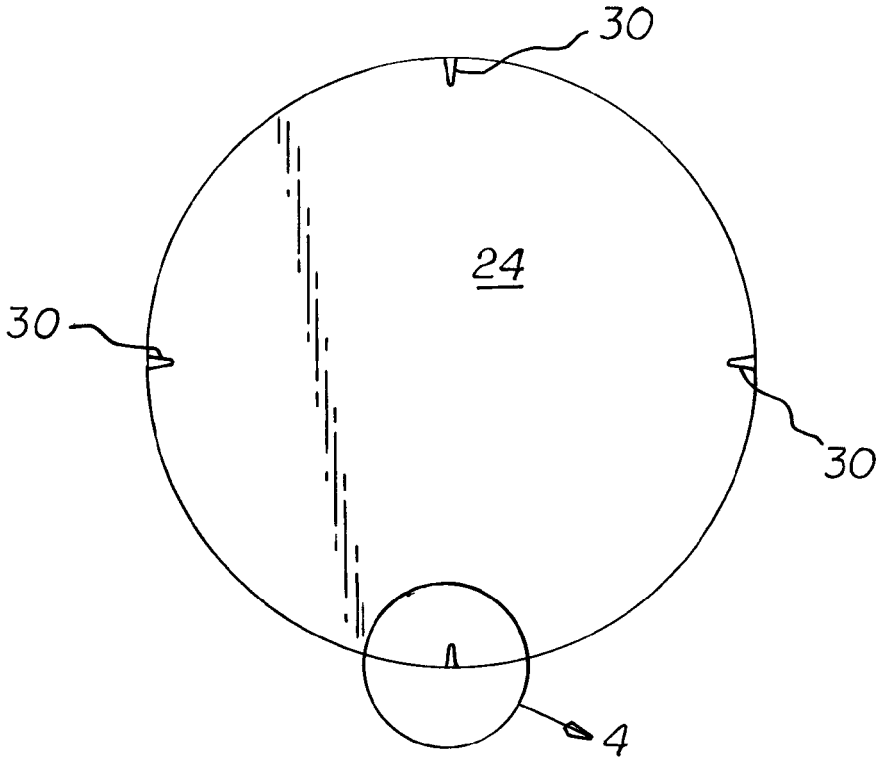
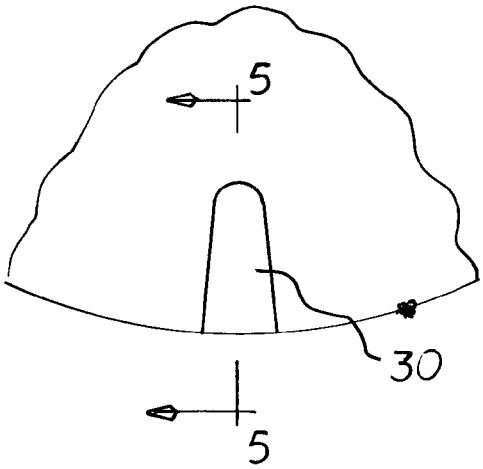
FIG. 4
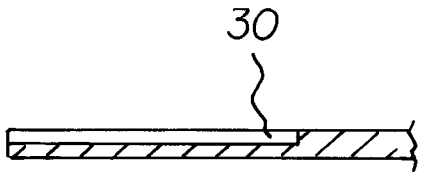
FIG. 5

TAMPER EVIDENT CROWN CAP SYSTEM AND METHOD

RELATED APPLICATION

This patent application is a continuation-in-part of pending U.S. patent application Ser. No. 12/583,104 filed Aug. 14, 2009, Ser. No. 13/405,910 filed Feb. 27, 2012 and Ser. No. 12/387,618 filed May 5, 2009, the subject matter of which applications is incorporated herein by reference.

BACKGROUND OF THE INVENTION

Field of the Invention

The present invention relates to a tamper evident crown cap system and method and more particularly pertains to attaching a crown cap to a bottle and for the removal thereof, such attaching and removing being done in a safe, ecological, convenient and economical manner.

SUMMARY OF THE INVENTION

In view of the disadvantages inherent in the known types of cap systems of known designs and configurations now present in the prior art, the present invention provides an improved pry-off tamper evident crown cap system. As such, the general purpose of the present invention, which will be described subsequently in greater detail, is to provide a new and improved pry-off tamper evident crown cap system and method which has all the advantages of the prior art and none of the disadvantages.

To attain this, the present invention essentially comprises a pry-off tamper evident crown cap system. First provided is crown cap adapted to be removably coupled to a bottle. The crown cap has a circular central region and a downwardly extending side wall in a generally cylindrical configuration. The side wall having a circular periphery with a plurality of recesses to facilitate shaping of the side wall, side wall terminating in an inwardly scrolled lower edge. The central region of the crown cap radially terminates in an upwardly extending exterior projection. The crown cap has a downwardly extending interior projection radially interior of the exterior projection. An adhesive is provided in the exterior projection.

The invention also includes the method of fabricating a crown cap and removably attaching such fabricated crown cap to a bottle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tamper evident crown cap system which has all of the advantages of the prior art systems and methods and none of the disadvantages.

It is another object of the present invention to provide a new and improved tamper evident crown cap system which may be easily and efficiently manufactured and marketed.

It is further object of the present invention to provide a new and improved tamper evident crown cap system which is of durable and reliable constructions.

An even further object of the present invention is to provide a new and improved tamper evident crown cap system which is susceptible of a low cost of manufacture with regard to both materials and labor, and which accordingly is then susceptible of low prices of sale to the consuming public, thereby making such pry-off tamper evident crown cap system economically available to the buying public.

Even still another object of the present invention is to provide a tamper evident crown cap system for attaching a crown cap to a bottle and for the removal thereof, such attaching and removing being done in a safe, ecological, convenient and economical manner.

Lastly, it is an object of the present invention to provide a new and improved tamper evident crown cap system and method. A crown cap is adapted to be removably coupled to a bottle. The crown cap has a circular central region and a downwardly extending side wall in a generally cylindrical configuration. The side wall having a circular periphery with a plurality of recesses to facilitate shaping of the side wall, side wall terminating in an inwardly scrolled lower edge. The central region of the crown cap radially terminates in an upwardly extending exterior projection. The crown cap has a downwardly extending interior projection radially interior of the exterior projection. An adhesive is provided in the exterior projection.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a cross sectional view of a pry-off tamper evident crown cap system on a bottle constructed in accordance with the principles of the present invention FIG. 2 is a plan view of the system taken along line 2-2 of FIG. 1.

FIG. 3 is plan view of the cap prior to shaping and coupling to a bottle.

FIG. 4 is an enlarged showing of a recess taken at circle 4 of FIG. 3.

FIG. 5 is a cross sectional view taken along line 5-5 of FIG. 4.

The same reference numerals refer to the same parts throughout the various Figures.

DESCRIPTION OF THE PREFERRED EMBODIMENT

Figure 6:
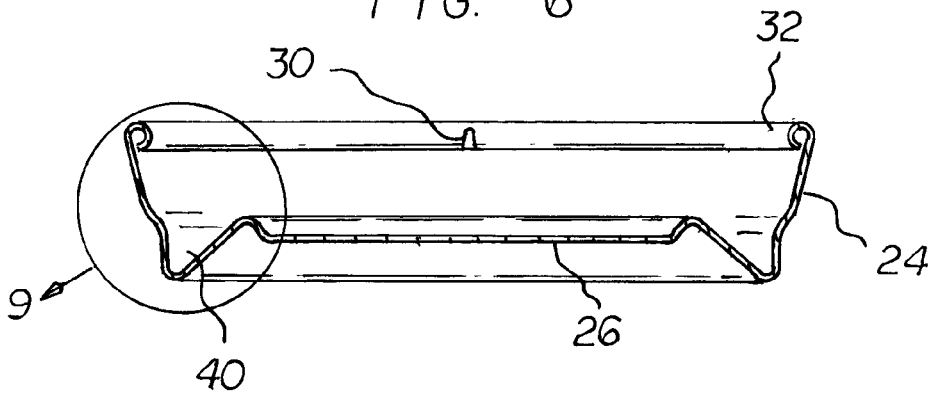
FIG. 6-8 are cross sectional views of the cap taken sequentially during the fabrication process.

With reference now to the drawings, and in particular to FIG. 1 thereof, the preferred embodiment of the new and improved pry-off tamper evident crown cap system embodying the principles and concepts of the present invention and generally designated by the reference numeral 10 will be described.

The present invention, the pry-off tamper evident crown cap system 10 is comprised of a crown cap configured and correlated with respect to each other so as to attain the desired objective.

First provided is a bottle 14. The bottle contains a liquid. The bottle is formed with a generally cylindrical body and an open top 16. The open top is formed with a circular lip 18 and an axially spaced outwardly extending projection 20 below the lip. The lip is in a horizontal plane at an elevation above a plane containing the outwardly extending projection. The bottle is fabricated of a non-corrosive material selected from the class of non-corrosive materials including glass, plastic, and aluminum.

Figure 9:
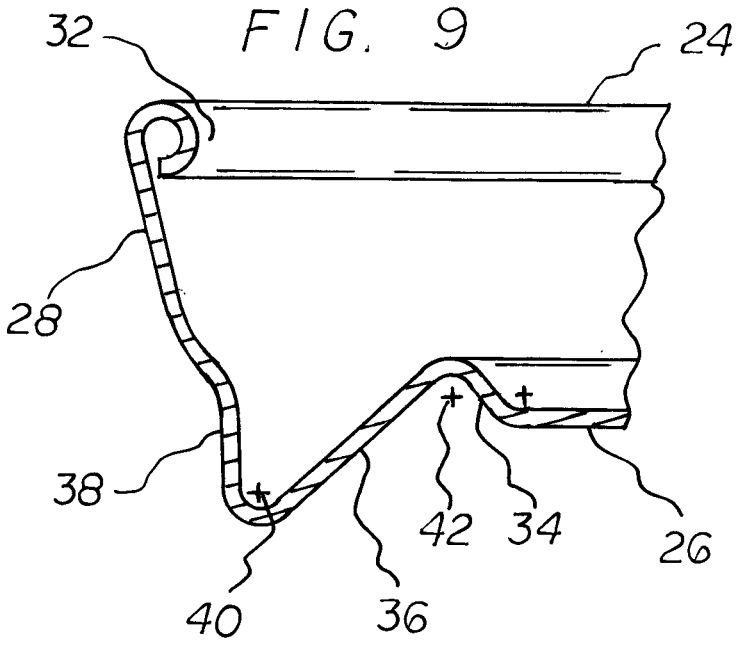
FIG. 9 is an enlarged showing the cap taken at circle 9 of FIG. 6.
Figure 10:
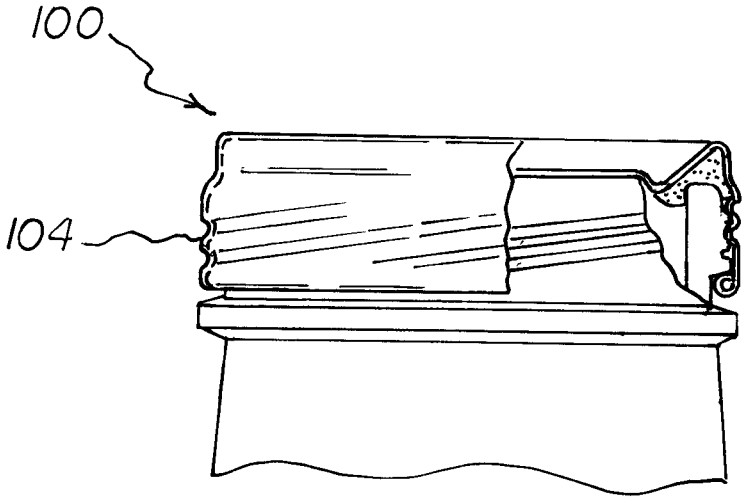
FIG. 10 is a side elevational view formed for a twist-off application.

Next provided is a crown cap 24 removably attached to the bottle. The crown cap has a horizontal circular central region 26 and a downwardly extending side wall 28 in a right circular cylindrical configuration with indicia thereon. Note FIGS. 1 and 3. The side wall has a circular periphery with a plurality of pie shaped recesses 30. The recesses have a depth from 25 to 75 percent of the thickness of the cap to facilitate the forming of the side wall. The side wall terminates in an inwardly scrolled lower edge 32 beneath the projection. Note FIG. 1. The crown cap central region has a downwardly extending first portion 34 forming a first radius of 0.020 inches. Note FIG. 9. A following upwardly extending second portion 36 forms a second radius of 0.020 inches. A following downwardly extending third portion 38 forms a third radius of 0.013 inches. The crown cap system with the radii as set fort above provides added strength to the system The majority of the second portion is above the horizontal plane. The minority of the second portion being below the horizontal plane. The second and third portions form an upwardly extending inverted V-shaped projection 40 positional above the lip of the bottle. The first and second portions form a downwardly extending U-shaped projection 42 radially interior of the V-shaped projection. Note FIG. 9. The crown cap is preferably fabricated of a non-corrosive aluminum.

The crown cap when removably attached to the bottle is positioned over and covering the top of the bottle. The inverted V-shaped projection is located above the lip of the bottle. The U-shaped projection is located within the bottle radially inward of the lip of the bottle. The side wall of the crown cap and inwardly scrolled lower edge form a tamper-secure lock and provide increased body strength to the crown cap.

Figure 7:
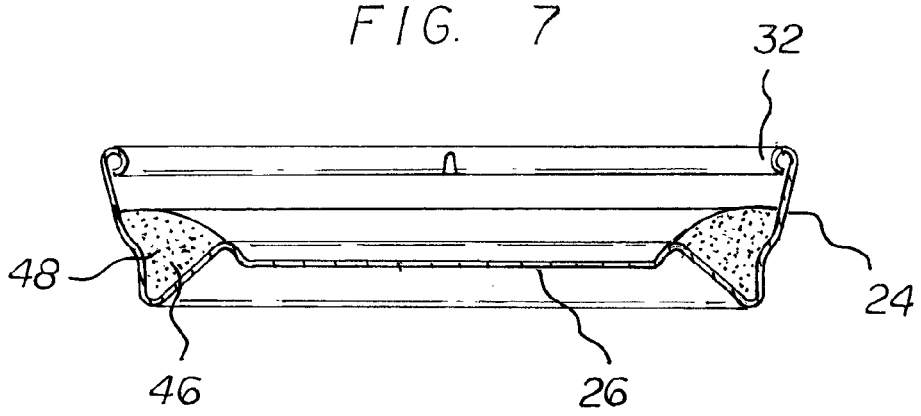
Figure 8:
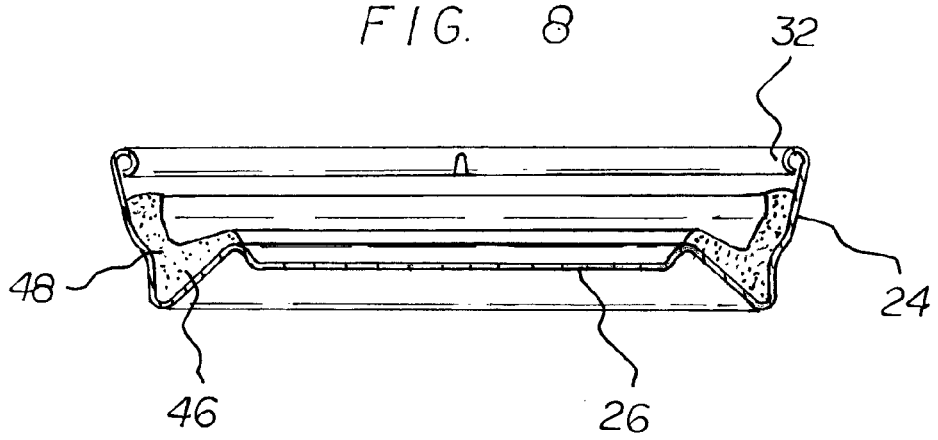

The crown cap is adapted to be inverted prior to being crimped and coupled to the bottle. The inverted V-shaped projection thereby forms an annular trough 46 with a chlorine-free hot melt adhesive 48 in the trough. Note FIGS. 7 and 8. The hot melt adhesive is chosen from the class of hot melt adhesives including chlorine-free plastic and rubber, natural and synthetic, and blends thereof. The hot melt adhesive is adapted to form a seal between the bottle and the crown cap. The hot melt adhesive extends for about 270 degrees from interior of the bottle projection, across the top of the bottle projection, down the exterior of the bottle projection and beneath a portion of the bottle projection.

In the present invention, the adhesive forms a liner designed to facilitate the use of a softer foamy rubber or plastic type material less than 60 durometers Shore A Hardness. Other prior designed closures use liner materials that exceed 80 durometers Shore A Hardness. Harder liners mean more pressures.

Pressures are critical when using environmentally friendly lighter weight aluminum and glass bottles. Prior art closures to the bottle using both side pressures of greater than 50 PSI and top pressures greater than 250 PSI. The present design of aluminum closure with the softer liner and the increase sealing surface allows the crimping our closure with on less than 40 PSI of side pressure and less than 100 PSI of top pressure.

The present liner design extends about 270 degrees around the 360 degrees sealing surface. This along with the softer liner material allows bottlers to apply our closure at lower crimping pressures and resulting in the use of lighter weight, more environmentally friendly bottles. Prior art closure liners only extend 90 to 100 degrees around the sealing surface.

The present invention also includes a method, the method of fabricating a tamper evident crown cap system and for attaching a crown cap to a bottle for the removal thereof. The steps in fabricating and attaching and removing are done in a safe, ecological, convenient and economical manner.

The first method step is providing a bottle for containing a liquid. The bottle is formed with a generally cylindrical body and an open top. The open top is formed with a circular lip and an axially spaced outwardly extending projection below the lip. The lip is in a horizontal plane at an elevation above a plane containing the outwardly extending projection. The bottle is fabricated of a non-corrosive material selected from the class of non-corrosive materials including glass, plastic, and aluminum.

The second step is providing a crown cap removably attached to the bottle. The crown cap has a circular central region and a downwardly extending side wall in a generally cylindrical configuration. The side wall has a circular periphery with a plurality of pie shaped recesses having a depth from 25 to 75 percent of the thickness of the cap. The side wall terminates in an inwardly scrolled lower edge. The steps include forming a downwardly extending first portion with a first radius, forming a following upwardly extending second portion with a second radius equal to the first radius, forming a following downwardly extending third portion with a third radius less than the first and second radii. The central region of the crown cap radially terminates in an upwardly extending inverted V-shaped projection positional above the lip of the bottle. The crown cap has a downwardly extending U-shaped projection radially interior of the V-shaped projection and positioned in the bottle. The crown cap is fabricated of a non-corrosive aluminum.

The next step is removably attaching the crown cap to the bottle. The crown cap is positioned over and covering the top of the bottle with the inverted V-shaped projection located above the lip of the bottle and the U-shaped projection located in the bottle radially inward of the lip of the bottle.

The next step is crimping the side wall of the crown cap whereby the scrolled lower edge of the crown cap is beneath and in continuous contact with a lower extent of the outwardly extending projection of the bottle to form a tamper-secure lock and to provide increased body strength to the crown cap.

Prior to being crimped and coupled to the bottle, the cap is inverted thereby forming an annular trough (40) with a chlorine-free hot melt adhesive (42) in the trough. Note FIG. 9. The hot melt adhesive is chosen from the class of hot melt adhesives including chlorine-free plastic and rubber, natural and synthetic, and blends thereof, the hot melt adhesive adapted to form a seal between the bottle and the crown cap.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A crown cap system comprising, in combination:

a crown cap (24) removably attached to the bottle, the crown cap having a thickness and a horizontal circular central region (26) and a downwardly extending side wall (28) in a right circular cylindrical configuration with indicia thereon, the side wall having a circular periphery with a plurality of pie shaped recesses (30) having a depth from 25 to 75 percent of the thickness of the cap to facilitate the forming of the side wall, the side wall terminating in an inwardly scrolled lower edge (32) beneath the projection, the crown cap central region having a downwardly extending first portion (34) forming a first radius, a following upwardly extending second portion (36) forming a second radius, a following downwardly extending third portion (38) forming a third radius, the majority of the second portion being above the horizontal plane, the minority of the second portion being below the horizontal plane, the second and third portions forming an upwardly extending inverted V-shaped projection (40) positional above the lip of the bottle, the first and second portions forming a downwardly extending U-shaped projection (42) radially interior of the V-shaped projection;

the circular central region having a downwardly extending first portion forming a first radius, a following upwardly extending second portion forming a second radius, a following downwardly extending third portion forming a third radius, the third radius being less than the first radius and the third radius being less than the second radius;

the side wall being in the shape of a right circular cylinder with indicia thereon;

the adhesive being a chlorine-free hot melt adhesive chosen from the class of hot melt adhesives including chlorine-free plastic and rubber, natural and synthetic, and blends thereof;

a bottle formed with a generally cylindrical body with an open top, the open top being formed with a circular lip, the bottle also formed with an axially spaced outwardly extending projection below the open top and the lip, the lip being in a horizontal plane at an elevation above a parallel plane extending through the outwardly extending projection, the top adapted to receive the crown cap with the adhesive in contact with the top and the lip and the projection; and the adhesive extending for about 270 degrees from interior of the bottle sealing surface projection, across the top of the bottle projection, down the exterior of the bottle projection and beneath a portion of the bottle projection.

2. The crown cap as set forth in claim 1 wherein the crown cap is a pry-off cap.

3. The crown cap (100) as set forth in claim 1 wherein the crown cap is a twist-off cap (104).

4. A pry-off tamper evident crown cap system (10) for attaching a crown cap to a bottle and for the removing thereof, such attaching and removing being done in a safe, ecological, convenient and economical manner, the system comprising, in combination:

a bottle (14) containing a liquid, the bottle being formed with a generally cylindrical body and an open top (16), the open top being formed with a circular lip (18) and an axially spaced outwardly extending projection (20) below the lip, the bottle being fabricated of a non-corrosive material selected from the class of non-corrosive materials including glass, plastic, and aluminum;

a crown cap (24) removably attached to the bottle, the crown cap having a horizontal circular central region (26) and a downwardly extending side wall (28) in a right circular cylindrical configuration with indicia thereon, the side wall having a circular periphery with a plurality of pie shaped recesses (30) having a depth from 25 to 75 percent of the thickness of the cap to facilitate the forming of the side wall, the side wall terminating in an inwardly scrolled lower edge (32) beneath the projection, the crown cap central region having a downwardly extending first portion (34) forming a first radius of 0.020 inches, a following upwardly extending second portion (36) forming a second radius of 0.020 inches, a following downwardly extending third portion (38) forming a third radius of 0.013 inches, the majority of the second portion being above the horizontal plane, the minority of the second portion being below the horizontal plane, the second and third portions forming an upwardly extending inverted V-shaped projection (40) positional above the lip of the bottle, the first and second portions forming a downwardly extending U-shaped projection (42) radially interior of the V-shaped projection, the crown cap being fabricated of a non-corrosive aluminum;

the crown cap when removably attached to the bottle being positioned over and covering the top of the bottle with the inverted V-shaped projection located above the lip of the bottle and the U-shaped projection located within the bottle radially inward of the lip of the bottle, the side wall of the crown cap and inwardly scrolled lower edge forming a tamper-secure lock and providing increased body strength to the crown cap, the lip being in a horizontal plane at an elevation above the downwardly extending first portion (34);

the crown cap adapted to be inverted prior to being crimped and coupled to the bottle, the inverted V-shaped projection thereby forming an annular trough (46) with a chlorine-free hot melt adhesive (48) in the trough, the hot melt adhesive being chosen from the class of hot melt adhesives including chlorine-free plastic and rubber, natural and synthetic, and blends thereof, the hot melt adhesive adapted to form a seal between the bottle and the crown cap, the hot melt adhesive extending for about 270 degrees from interior of the bottle projection, across the top of the bottle projection, down the exterior of the bottle projection and beneath a portion of the bottle projection.

* * * * *